US008555964B2

(12) United States Patent
MacLeod

(10) Patent No.: US 8,555,964 B2
(45) Date of Patent: Oct. 15, 2013

(54) CENTRALISER

(75) Inventor: Iain MacLeod, Aberdeen (GB)

(73) Assignee: Petrowell Limited, Dyce, Aberdeen (GB)

( * ) Notice: Subject to any disclaimer, the term of this patent is extended or adjusted under 35 U.S.C. 154(b) by 488 days.

(21) Appl. No.: 12/743,505

(22) PCT Filed: Nov. 28, 2008

(86) PCT No.: PCT/GB2008/003957

§ 371 (c)(1),
(2), (4) Date: Oct. 15, 2010

(87) PCT Pub. No.: WO2009/071874

PCT Pub. Date: Jun. 11, 2009

(65) Prior Publication Data

US 2011/0042106 A1 Feb. 24, 2011

(30) Foreign Application Priority Data

Dec. 3, 2007 (GB) ..... 0723607.8

(51) Int. Cl.
*E21B 17/10* (2006.01)

(52) U.S. Cl.
USPC ..... 166/241.6; 166/241.1

(58) Field of Classification Search
USPC ..... 166/241.1, 241.6
See application file for complete search history.

(56) References Cited

U.S. PATENT DOCUMENTS

| | | | | |
|---|---|---|---|---|
| 643,358 | A | | 2/1900 | Konold |
| 2,009,322 | A | | 7/1935 | Emil |
| 2,181,748 | A | | 11/1939 | Thaheld |
| 2,311,768 | A | * | 2/1943 | McCray ..... 166/213 |
| 2,498,791 | A | | 2/1950 | Clark |
| 2,546,377 | A | | 3/1951 | Turechek |
| 2,738,018 | A | | 3/1956 | Lynes |
| 2,832,418 | A | | 4/1958 | Baker |
| 3,066,738 | A | | 12/1962 | Myers |
| 3,087,552 | A | | 4/1963 | Graham |
| 3,167,127 | A | | 1/1965 | Sizer |
| 3,167,128 | A | | 1/1965 | Sutliff |
| 3,283,821 | A | | 11/1966 | Brown |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

PCT/GB2005/001391, Int'l Prelim. Report on Patentability, Jun. 23, 2005.

(Continued)

*Primary Examiner* — Giovanna Wright
(74) *Attorney, Agent, or Firm* — Wong, Cabello, Lutsch, Rutherford & Brucculeri LLP

(57) ABSTRACT

A centralizer (10) for centralizing a tubular in a conduit is described. The centralizer comprises a body comprising a upper body portion (12) and a lower body portion (14) and a plurality of arms (16) linking the upper body portion to the lower body portion. Relative movement of the upper and lower body portions towards each other causes the arms to buckle radially outwards into a set configuration in which the arms are engaged, in use, with a conduit.

36 Claims, 4 Drawing Sheets

(56) References Cited

U.S. PATENT DOCUMENTS

| | | | | | |
|---|---|---|---|---|---|
| 3,342,268 | A | | 9/1967 | Brown | |
| 3,371,716 | A | | 3/1968 | Current | |
| 3,482,889 | A | | 12/1969 | Cochran | |
| 3,623,551 | A | | 11/1971 | Randermann | |
| 3,722,588 | A | | 3/1973 | Tamplen | |
| 3,729,170 | A | | 4/1973 | Lewis | |
| 3,889,750 | A | | 6/1975 | Mullins | |
| 4,046,405 | A | | 9/1977 | Bonds | |
| 4,127,168 | A | | 11/1978 | Hanson | |
| 4,317,485 | A | | 3/1982 | Ross | |
| 4,331,315 | A | | 5/1982 | Geisow | |
| 4,346,919 | A | | 8/1982 | Morrill | |
| 4,375,240 | A | | 3/1983 | Baugh | |
| 4,557,327 | A | * | 12/1985 | Kinley et al. | 166/241.5 |
| 4,588,030 | A | | 5/1986 | Blizzard | |
| 4,917,187 | A | | 4/1990 | Burns | |
| 2,230,447 | A | | 2/1991 | Bassinger | |
| 5,058,684 | A | | 10/1991 | Winslow | |
| 5,095,978 | A | | 3/1992 | Akkerman | |
| 5,261,488 | A | | 11/1993 | Gullet et al. | |
| 5,542,473 | A | | 8/1996 | Pringle | |
| 5,575,333 | A | * | 11/1996 | Lirette et al. | 166/241.1 |
| 6,062,307 | A | | 5/2000 | Gosse | |
| 6,315,041 | B1 | | 11/2001 | Carlisle | |
| 6,453,998 | B1 | * | 9/2002 | Reeve | 166/241.1 |
| 7,690,424 | B2 | | 4/2010 | McLeod | |
| 7,708,063 | B2 | * | 5/2010 | Palmer | 166/241.1 |
| 2003/0000607 | A1 | | 1/2003 | Jenner | |
| 2004/0055757 | A1 | | 3/2004 | Beall | |
| 2005/0224227 | A1 | | 10/2005 | Hendrie | |
| 2008/0283237 | A1 | * | 11/2008 | Buytaert et al. | 166/196 |
| 2009/0308592 | A1 | | 12/2009 | Mercer | |

FOREIGN PATENT DOCUMENTS

| | | |
|---|---|---|
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2245624 | 8/1992 |
| GB | 2328230 | 2/1999 |
| GB | 2428708 | 2/2007 |
| WO | WO02/4262 | 5/2002 |
| WO | WO 2005/026494 | 3/2005 |
| WO | WO2005121498 | 12/2005 |
| WO | WO 2006/046075 | 5/2006 |
| WO | WO 2007/109878 | 10/2007 |

OTHER PUBLICATIONS

PCT/GB2005/001391, International Search Report, Jun. 23, 2005.
PCT/GB2005/001391, Written Opinion, Jun. 23, 2005.
PCT/GB2005/004200, Written Opinion, Apr. 10, 2006.
PCT/GB2005/004200, Int'l Prelim. Report on Patentability, May 1, 2007.
PCT/GB2005/004200, International Search Report, Jan. 11, 2006.
PCT/GB2005/003871 Int'l Prelim. Report on Patentability, Sep. 11, 2007.
PCT/GB2005/003871, International Search Report, Nov. 17, 2005.
Office Action dated Mar. 30, 2009, Applicant's co-pending U.S. Appl. No. 11/816,421, filed Mar. 30, 2009.
Office Action dated Sep. 28, 2009, Applicant's co-pending U.S. Appl. No. 11/816,421, filed Sep. 28, 2009.
PETR103-OA-UK-20051101, Foreign Office Action dated Nov. 1, 2005.
PCT/GB2005/003871, Written Opinion, Nov. 22, 2005.
PCTGB2006001297, Int'l Prelim. Report on Patentability and Written Opinion, Oct. 9, 2007.
PCTGB2006001297, International Search Report, Oct. 9, 2007.
Office Action dated May 29, 2009, Applicant's co-pending U.S. Appl. No. 11/909,820, filed May 29, 2009.
11/909820-PETR104-OA-02-17- 2010, Office Action dated Feb. 17, 2010, Applicant's co-pending U.S. Appl. No. 11/909,820, filed Feb. 19, 2010.
PCTGB2007001040, International Search Report, Jun. 5, 2010.
PCTGB2007001040, Int'l Prelim. Report on Patentability and Written Opinion, Sep. 23, 2008.
PCTGB2007004372, Int'l Prelim. Report on Patentability and Written Opinion May 19, 2009.
PCTGB2007004372, International Search Report, Jan. 23, 2008.
PCTGB2008002042, Int'l Prelim. Report on Patentability and Written Opinion, Dec. 20, 2009.
PCTGB2008002042, International Search Report, Oct. 17, 2008.
PCTGB2009071874, Int'l Prelim. Report on Patentability and Written Opinion, Jun. 8, 2010.
PCTGB2009071874, International Search Report, Jul. 23, 2009.
PCT/GB2008003883, Int'l Prelim. Report on Patentability and Written Opinion, May 25, 2010.
PCTGB2008003883, International Search Report, Mar. 26, 2009.
PCTGB200900048300, Int'l Prelim. Report on Patentability and Written Opinion, Aug. 24, 2010.
PCTGB200900048300, International Search Report, Sep. 28, 2009.
11/577866-PETR102-OA-08-25-2010, Office Action dated Aug. 25, 2010, Applicant's co-pending U.S. Appl. No. 11/577,866, filed Aug. 25, 2010.
Pursuant to MPEP § 2001.6(b) applicants bring the following co-pending applications to the Examiner's attention: U.S. Appl. Nos. 11/570,335, 11/577,866, 11/909,820, 12/294,078, 12/514,488, 12/665,641, 12/933,015, 12/743,397, 12/866,495, and 12/933,053.
International Search Report for PCT/GB2009/000770, Sep. 24, 2009.
Written Opinion for PCT/GB2009/000730, Sep. 18, 2010.
Office Action, Applicant's co-pending U.S. Appl. No. 11/909,820, filed Oct. 7, 2010.
International Search Report for PCT/GB2009/000770, Oct. 8, 2009.
Written Opinion for PCT/GB2009/000770, Sep. 29, 2010.

* cited by examiner

CENTRALISER

FIELD OF THE INVENTION

The present invention relates to a centraliser for centralising a tubular in a conduit.

BACKGROUND TO THE INVENTION

During well completion operations it is often desirable to cement a tubular inside another conduit. This other conduit may be a cased well bore or an open hole formation or the like. To ensure optimal efficiency of the cementing process, it is desirable to have the tubular spaced away from the sides of the conduit to permit cement to flow between the tubular and the conduit around the entire circumference of the tubular. This spacing of the tubular with respect to the conduit is achieved using a centraliser.

There are a number of types of conventional centraliser on the market. For example, bow centralisers centralise, as their name suggests, by bowing a piece of metal into engagement with a conduit wall to space a tubular centrally in the conduit. Bow spring centralisers have drawbacks. For example, bow spring centralisers have limited load bearing capacity meaning they can fail to move the tubular into an optimum centralised position with respect to the conduit.

Other centraliser assemblies are provided which have a greater load bearing capacity but are made of many components such as legs, buttons, pistons etc. which are necessary to energise their centralising feature.

SUMMARY OF THE INVENTION

According to a first aspect of the present invention, there is provided a centraliser for centralising a tubular in a conduit, the centraliser comprising:

a body comprising a upper body portion and a lower body portion; and a plurality of arms linking the upper body portion to the lower body portion;

wherein relative movement of the upper and lower body portions towards each other causes the arms to buckle radially outwards into a set configuration in which the arms are engaged, in use, with a conduit.

In one embodiment, a centraliser according to the present invention, can be used to centralise a tubular within a conduit.

Preferably, the body and the arms are unitary. By unitary it is meant the body and the arms are manufactured from a single piece of material.

Preferably, the centraliser is tubular.

Preferably, the body and the arms are machined from a tubular section.

Preferably, relative axial movement of the body portions towards each other causes the arms to buckle radially outwards.

Preferably, during relative axial movement of the body portions towards each other, one of said body portions remains stationary.

Preferably, axial movement in a setting direction of one of said body portions towards the other of said body portions in a setting direction causes the arms to buckle radially outwards.

Most preferably, axial movement of the upper body portion towards the lower body portion causes the arms to buckle radially outwards.

Preferably, the buckling of the arms is non-reversible.

Preferably, as one of said body portions moves towards the other of said body portions, the said body portions engage one another.

Most preferably, as the upper body portion moves towards the lower body portion, the body portions engage one another.

Preferably, the engagement of the upper and lower body portions is non-reversible. Making the engagement non-reversible maintains the centraliser in the set configuration.

Preferably, the engagement of the upper and lower body portions prevents movement of the upper body portion with respect to the lower body portion in a direction opposite the setting direction.

Preferably, the upper and lower body portions define a ratchet. A ratchet is provided to prevent the centraliser from releasing from the set configuration.

Preferably, the upper and lower body portions are adapted to form an overlap.

Preferably, when the upper and lower body portions have formed an overlap, an upper body portion internal surface engages a lower body portion external surface.

Preferably, the upper body portion internal surface and the lower body portion external surface engage such that relative movement in the direction opposite the setting direction is prevented.

Preferably, the upper body internal surface and the lower body external surface define complementary ratchet threads adapted to engage and permit unidirectional movement therebetween.

Preferably, the upper body portion defines a plurality of fingers.

Preferably, each upper body finger defines a tip.

Preferably, during movement in the setting direction each upper body fingertip engages the lower body portion.

Preferably, upon engagement each upper body finger deflects radially outwards.

Preferably, each upper body finger deflects radially outwards about a hinge.

Preferably, the hinge is a living hinge.

Preferably, during movement in the setting direction, each upper body finger is adapted to form the overlap with the lower body portion.

In an alternative embodiment, where the upper and lower body portions form an overlap, an upper body portion external surface engages a lower body portion internal surface.

Preferably, in this embodiment, the upper body portion external surface and the lower body portion internal surface engage such that relative movement in the direction opposite the setting direction is prevented.

Preferably, in this embodiment, the upper body external surface and the lower body internal surface define complementary ratchet threads adapted to engage and permit unidirectional movement therebetween.

In this embodiment, the upper body portion may define a plurality of fingers which deflect radially inwards during movement in the setting direction.

In a further alternative embodiment, the centraliser is located on a tubular. In this embodiment, as the body portions move relative to one another, one of said portions engages the tubular.

Preferably, the engagement of the centraliser and the tubular is non-reversible.

In a further alternative embodiment, the lower body portion moves axially towards the upper body portion in a setting direction, causing the arms to buckle radially outward.

Preferably, each arm defines at least one point of weakness. Points of weakness are provided to ensure the arm buckles predictably.

Preferably, each arm defines three points of weakness.

Preferably, there are two points of weakness on an external surface and one on an internal surface of each arm.

In one embodiment there may be more than three points of weakness.

Preferably, at least one of said point of weakness is a circumferential groove defined by the centraliser.

In one embodiment, one of said circumferential groove comprises each upper body finger living hinge.

Preferably, the centraliser is adapted to located between adjacent tubular sections. This means the centraliser can be run-in by a diameter no greater than the outside diameter of the tubular.

Alternatively, the centraliser is attached to a tubular.

Preferably, in use with a tubular, one of the body portions is fixed with respect to the tubular.

In one embodiment, the lower body portion is fixed directly to the tubular.

Preferably, in use, the centraliser is set by means of a setting sleeve.

While the upper body portion moves axially towards the lower body portion, the centraliser is set by means of a setting sleeve acting on the upper body portion.

A setting sleeve can be activated by any method such as hydraulic, mechanical or other means.

In one embodiment, where the upper body portion moves axially towards the lower body portion, the upper body portion is attached, in use, to a tubular by shear screws. Using shear screws prevents the centraliser firstly from setting accidentally.

According to a second aspect of the present invention there is provided a method of centralising a tubular in a conduit comprising the steps of:

applying a setting force in a setting direction to move a centraliser upper body portion and a centraliser lower body portion together;

buckling arms linking the upper body portion to the lower body portion radially outwards into engagement with a conduit wall.

Preferably, the method further comprises the step of engaging the upper body portion with the lower body portion.

Preferably, the step of engaging the upper body portion with the lower body portion comprises engaging an upper body portion internal surface with a lower body portion external surface.

Preferably, the engagement of the upper and lower body portions is non-reversible.

BRIEF DESCRIPTION OF THE DRAWINGS

An embodiment of the present invention will now be described with reference to the accompanying drawings in which.

DETAILED DESCRIPTION OF THE DRAWINGS

Figure 1:
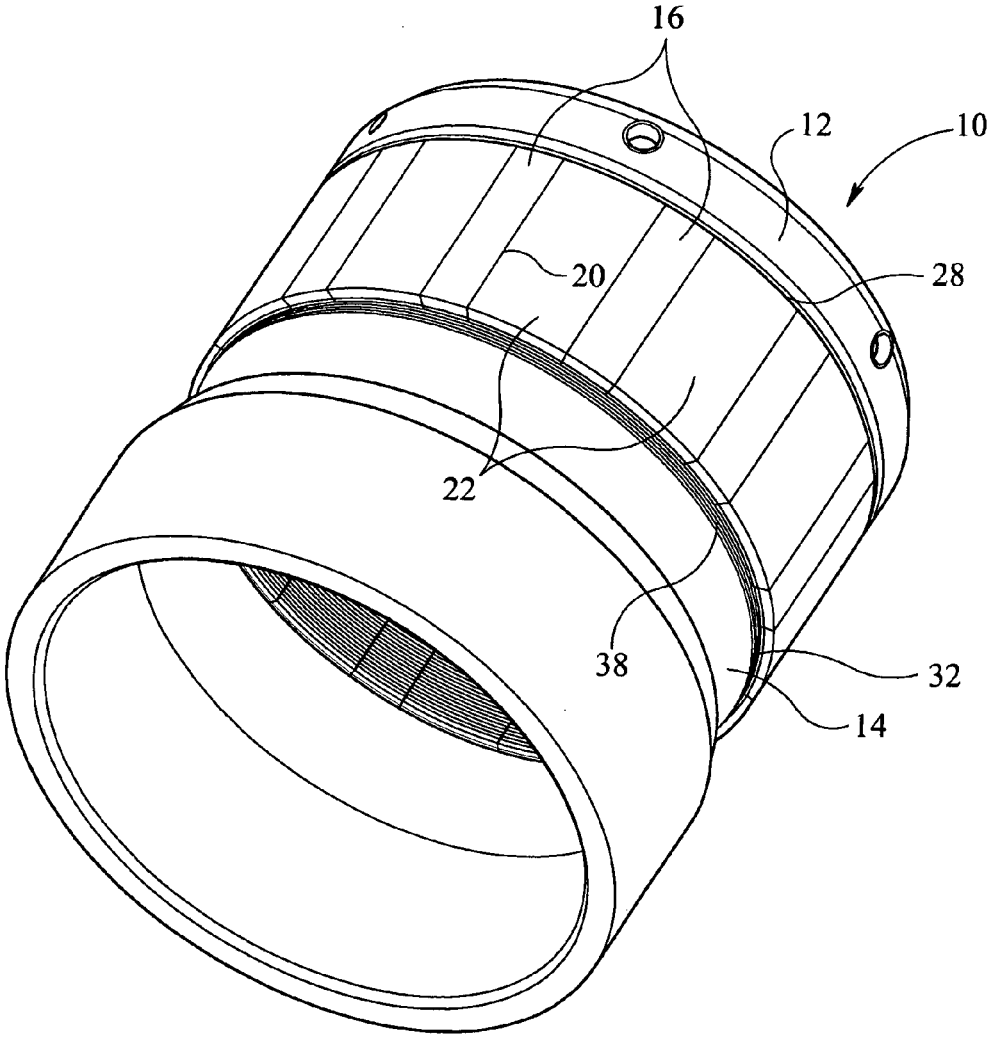
FIG. 1 is a perspective view of the centraliser in a run-in configuration according to an embodiment of the present invention.
Figure 2:
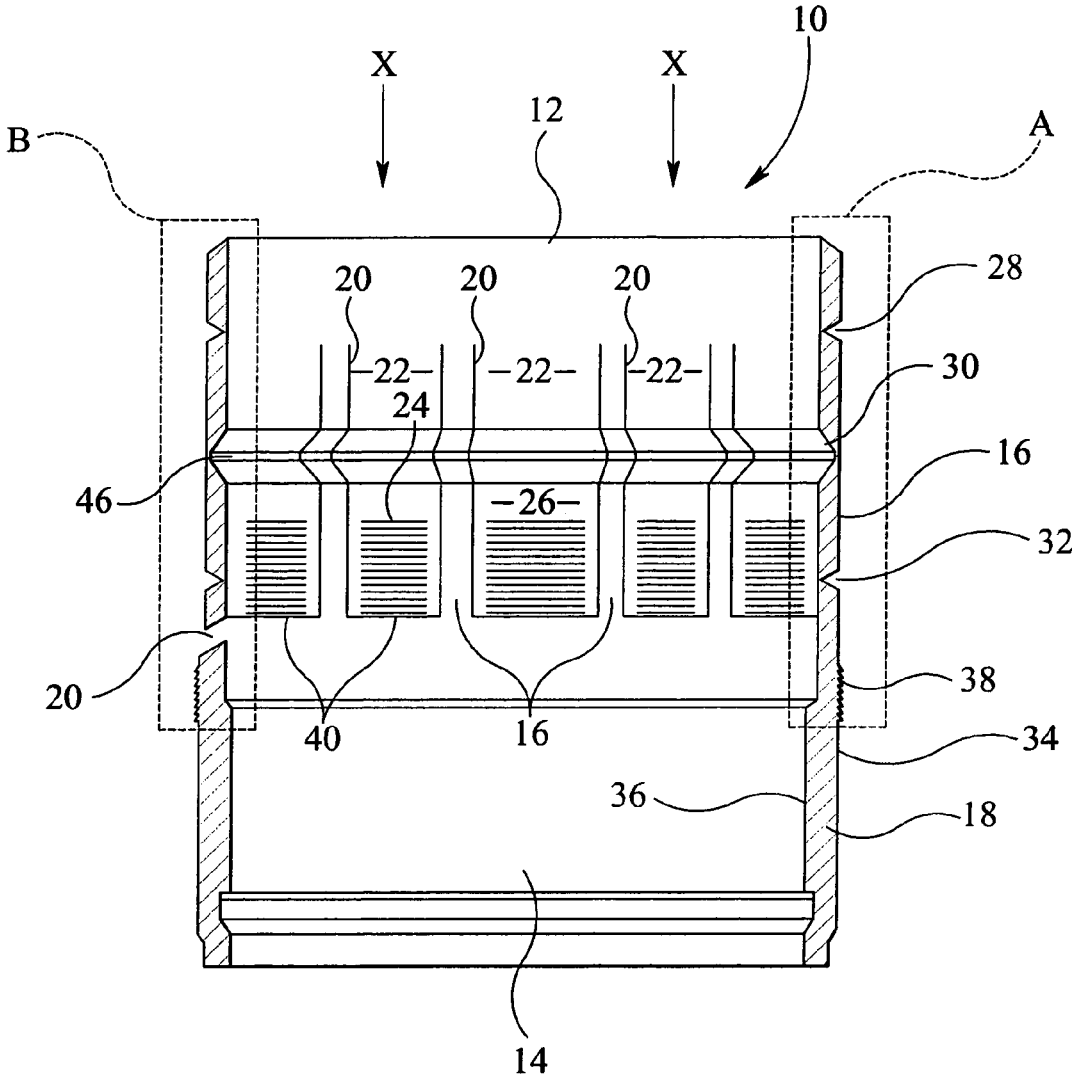
FIG. 2 is a section view of the centraliser of FIG. 1.

Referring firstly to FIGS. 1 and 2, there is shown perspective and section views of a centraliser, respectively, generally indicated by reference numeral 10 according to an embodiment of the present invention. The centraliser 10 is for centralising a tubular (not shown) within a conduit (not shown).

Figure 5:
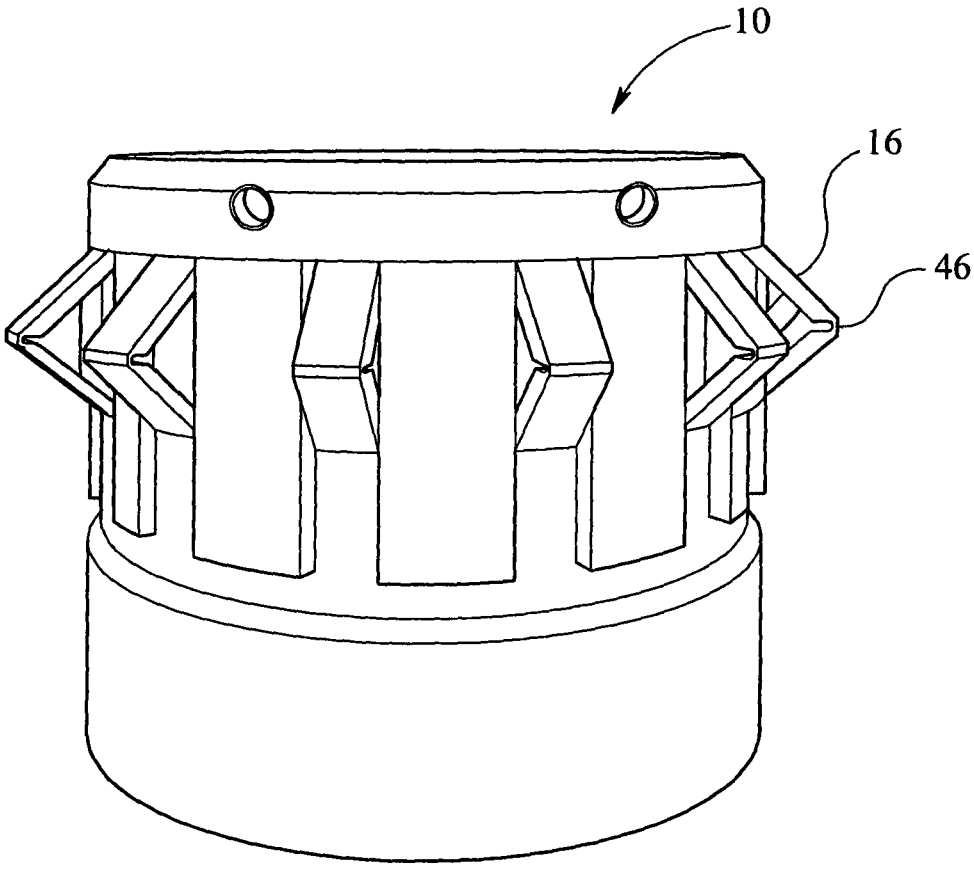
FIG. 5 is a front view of the centraliser of FIG. 1 in a set configuration.

The centraliser 10 comprises an upper body portion 12, a lower body portion 14 and a plurality of arms 16 linking the upper body portion 12 to the lower body portion 14. As will be discussed, relative movement of the upper body portion 12 towards the lower body portion 14 causes the arms 16 to buckle radially outwards into a set configuration in which the arms 16 are engaged with the conduit (not shown). The centraliser 10 is shown in the set configuration (but not engaged with a conduit) in FIG. 5. The centraliser 10 is adapted to be located around the tubular (not shown). Engagement of the centraliser arms 16 with a conduit centralises the tubular within the conduit.

The centraliser 10 is machined out of a single length of tubular 18. A series of u-shaped slots 20 are made through the wall of the tubular 18 to form a plurality of upper body portion fingers 22. Each finger 22 is sandwiched between a pair of arms 16 and has an internal surface 26 defining a ratchet thread 24. The purpose of this internal surface ratchet thread 24 will be described in due course.

The upper body portion 12 further defines three circumferential grooves 28,30,32. The upper and lower grooves 28,32 are defined by a centraliser external surface 34 and the internal groove 30, which is located axially between the external grooves 28,32, is defined by a centraliser internal surface 36.

A lower body portion external surface 52 also defines a ratchet thread 38. The purpose of this external surface ratchet thread 38 will be described in due course.

Figure 3:
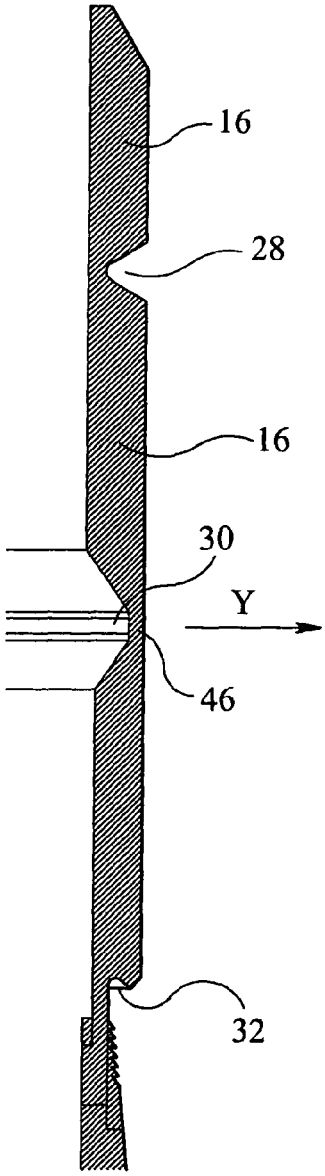
FIG. 3 is an enlarged view of the region "A" of FIG. 2.
Figure 4:
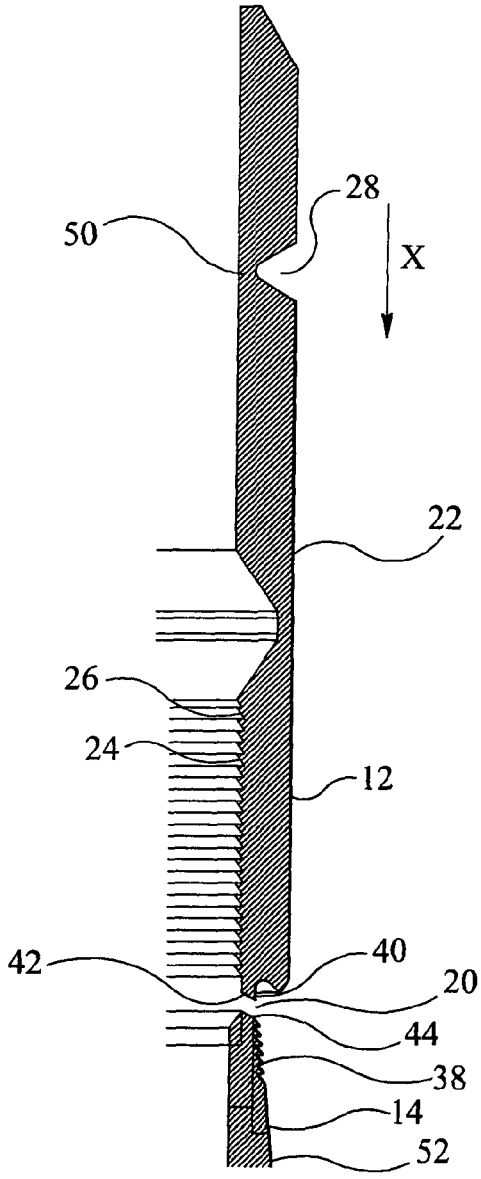
FIG. 4 is an enlarged view of the region "B" of FIG. 2.

Referring to FIGS. 3 and 4, these Figures show an enlarged view of region "A" from FIG. 2 and an enlarged view of region "B" from FIG. 2 respectively. Particularly, FIG. 3 shows a section view through one of the arms 16 and FIG. 4 shows a section view through one of the upper body portion fingers 22.

Referring to FIG. 3, the three grooves 28,30,32 about which the arm 16 buckles radially outwards can be seen. These grooves 28,30,32 represent three points of weakness.

From FIG. 4, showing a section view through one of the upper body portion fingers 22, the internal surface ratchet thread 24 defined by the finger internal surface 26 can be seen. Also visible is the external surface ratchet thread 38 on the lower body portion 14.

Also visible from FIG. 4 is the lower edge 40 of one of the u-shaped slots 20. As can be seen the lower edge slot 40 is cut such that the bottom 42 of the upper body portion finger 22 is angled, as is the top 44 of the adjacent part of the lower body portion 14.

Operation of the centraliser 10 will now be discussed. To activate the centraliser 10, an axial force is applied to the upper body portion 12 in the direction of arrows 'X' and FIG. 1 by a setting agent (not shown). This force causes the arms 16 to buckle outwards, in the direction of arrow 'Y' (FIG. 3) such that the mid-point 46 of each arm 16 comes into engagement with the conduit wall (not shown).

Simultaneously, with the buckling of the arms 16, the upper body portion fingers 22 move axially towards the lower body portion 14. Referring to FIG. 4, the bottom 42 of each finger 22 comes into contact with the top 44 of the upper body portion 14. The angled surfaces provided on the bottom 42 and the top 44 are such that upon impact each finger 22 is deflected outwards, bending about a living hinge 50, provided by the thin wall thickness at the base of the upper groove 28. The finger internal surface 26 then passes over the lower body portion external surface 52 and, in particular, the finger internal surface ratchet thread 24 passes over the lower body portion external surface ratchet thread 38. These ratchet threads 24,38 are arranged such that movement of the fingers 22 in the direction of arrow 'X', that is in the setting direction, is allowed, but movement in the direction opposite arrow 'X', that is opposite the setting direction, is resisted by engagement of the ratchet threads 24,38. The setting force continues until the centraliser is in the set configuration shown in FIG. 5.

Various improvements and modifications may be made to the above described embodiment without departing from the scope of the present invention. For example, although complementary engaging ratchet threads are shown, some other sort of ratchet mechanism could be provided between the upper and lower body portions to prevent the centraliser from releasing from the set configuration.

The invention claimed is:

1. A centraliser for centralising a tubular in a conduit, the centraliser comprising:

a body comprising an upper body portion and a lower body portion; and a plurality of arms linking the upper body portion to the lower body portion, wherein the body and the arms are a single piece construction;

wherein relative movement of the upper and lower body portions towards each other causes the arms to buckle radially outwards into a set configuration in which the arms are engaged, in use, with a conduit.

2. The centraliser of either of claim 1, wherein the centraliser is tubular.

3. The centraliser of claim 1, wherein the body and the arms are machined from a tubular section.

4. The centraliser of claim 1, wherein relative axial movement of the body portions towards each other causes the arms to buckle radially outwards.

5. The centraliser of either of claim 4, wherein axial movement in a setting direction of one of said body portions towards the other of said body portions in a setting direction causes the arms to buckle radially outwards.

6. The centraliser of claim 1, wherein the buckling of the arms is non-reversible.

7. The centraliser of claim 1, wherein as one of said body portions moves towards the other of said body portions, the said body portions engage one another.

8. The centraliser of claim 7, wherein the engagement of the upper and lower body portions is non-reversible.

9. The centraliser of claim 7, wherein the engagement of the upper and lower body portions prevents movement of the upper body portion with respect to the lower body portion in a direction opposite the setting direction.

10. The centraliser of claim 1, wherein the upper and lower body portions define a ratchet.

11. The centraliser of claim 1, wherein, the upper and lower body portions are adapted to form an overlap.

12. The centraliser of claim 11, wherein the upper and lower body portions have formed an overlap, an upper body portion internal surface engages a lower body portion external surface.

13. The centraliser of claim 12, wherein the upper body portion internal surface and the lower body portion external surface engage such that relative movement in the direction opposite the setting direction is prevented.

14. The centraliser of claim 13, wherein the upper body internal surface and the lower body external surface define complementary ratchet threads adapted to engage and permit unidirectional movement therebetween.

15. The centraliser of any of claim 11, wherein during movement in the setting direction, each upper body finger is adapted to form the overlap with the lower body portion.

16. The centraliser of claim 11, wherein where the upper and lower body portions form an overlap, an upper body portion external surface engages a lower body portion internal surface.

17. The centraliser of claim 16, wherein the upper body portion external surface and the lower body portion internal surface engage such that relative movement in the direction opposite the setting direction is prevented.

18. The centraliser of claim 16, wherein the upper body external surface and the lower body internal surface define complementary ratchet threads adapted to engage and permit unidirectional movement therebetween.

19. The centraliser of claim 16, wherein the upper body portion may define a plurality of fingers which deflect radially inwards during movement in the setting direction.

20. The centraliser of claim 1, wherein the upper body portion defines a plurality of fingers.

21. The centraliser of claim 20, wherein during movement in the setting direction each upper body fingertip engages the lower body portion.

22. The centraliser of claim 21, wherein upon engagement each upper body finger deflects radially outwards.

23. The centraliser of claim 22, wherein each upper body finger deflects radially outwards about a hinge.

24. The centraliser of claim 1, wherein as the body portions move relative to one another, one of said portions engages a tubular upon which the centraliser is located.

25. The centraliser of claim 24, wherein the engagement of the centraliser and the tubular is non-reversible.

26. The centraliser of claim 1, wherein each arm defines at least one point of weakness.

27. The centraliser of claim 26, wherein each arm defines three points of weakness.

28. The centraliser of claim 27, wherein there are two points of weakness on an external surface and one on an internal surface of each arm.

29. The centraliser of claim 26, wherein there is more than three points of weakness.

30. The centraliser of claim 26, wherein at least one of said point of weakness is a circumferential groove defined by the centraliser.

31. The centraliser of claim 30, wherein one of said circumferential groove comprises each upper body finger living hinge.

32. A method of centralising a tubular in a conduit comprising the steps of:

providing a body comprising a upper body portion and a lower body portion and a plurality of arms linking the upper body portion to the lower body portion, wherein the body and the arms are a single piece of material construction;

applying a setting force in a setting direction to move the centraliser upper body portion and the centraliser lower body portion together; and buckling the arms linking the upper body portion to the lower body portion radially outwards into engagement with a conduit wall.

33. The method of claim 32, wherein the method further comprises the step of engaging the upper body portion with the lower body portion.

34. The method of claim 32, wherein the step of engaging the upper body portion with the lower body portion comprises engaging an upper body portion internal surface with a lower body portion external surface.

35. The method of claim 32, wherein the engagement of the upper and lower body portions is non-reversible.

36. A centraliser for centralising a tubular in a conduit, the centraliser comprising:

a body comprising an upper body portion and a lower body portion; and a plurality of arms linking the upper body portion to the lower body portion;

wherein relative movement of the upper and lower body portions towards each other causes the arms to buckle radially outwards into a set configuration in which the arms are engaged, in use, with a conduit, and wherein the upper body portion and the lower body portion are adapted to form an overlap, an upper body portion internal surface engaging a lower body portion external surface.

* * * * *